United States Patent [19]

Walk

[11] Patent Number: 4,697,652

[45] Date of Patent: Oct. 6, 1987

[54] REVERSIBLE ROLLER STABILIZER EXTENSIONS FOR EARTH BORING HEAD

[75] Inventor: Howard J. Walk, Arlington, Tex.

[73] Assignee: Reed Mining Tools, Inc., Grand Prairie, Tex.

[21] Appl. No.: 909,273

[22] Filed: Sep. 19, 1986

[51] Int. Cl.[4] ..... E21B 3/00; E21C 9/00

[52] U.S. Cl. ..... 175/325; 175/53

[58] Field of Search ..... 166/241; 175/97, 325, 175/53; 279/102; 299/89, 90

[56] References Cited

U.S. PATENT DOCUMENTS

| | | | |
|---|---|---|---|
| 4,301,876 | 11/1981 | Harrison et al. | 175/53 |
| 4,365,677 | 12/1982 | Owens | 175/53 X |
| 4,386,670 | 6/1983 | Westermark | 175/53 X |
| 4,448,270 | 5/1984 | Buske | 175/325 X |
| 4,547,833 | 10/1985 | Sharp | 175/325 X |
| 4,627,501 | 12/1986 | Ebeling | 175/325 X |

*Primary Examiner*—Stephen J. Novosad

*Attorney, Agent, or Firm*—Arthur F. Zobal

[57] ABSTRACT

The stabilizer extensions are brackets with rollers employed for stabilizing a large boring head when drilling a bore hole in the earth. A hub is provided for attachment to the head. The hub has a plurality of mounting plates located around its axis and radially outward therefrom. Each of the brackets has a bracket mounting plate at one end and a roller mounting plate at the other end. A roller is attached to each of the roller mounting plates for engaging the earth for stabilizing the head. The axis of each of the rollers defines a scalene triangle with two side edges of the bracket mounting plate of its extension bracket. The bracket mounting plate of each of the extension brackets is adapted to be attached to any of the hub mounting plates in a first position or turned 180° and attached thereto in a second position such that the axis of its roller is parallel to the axis of the hub and is located either on one side or the other of a plane extending from the length of the axis of the hub outward and bisecting the bracket mounting plate between its two side edges when the bracket mounting plate is attached to any of the hub mounting plates in said first or second positions.

16 Claims, 12 Drawing Figures

REVERSIBLE ROLLER STABILIZER EXTENSIONS FOR EARTH BORING HEAD

BACKGROUND OF THE INVENTION

1. Field of the Invention

The invention relates to an apparatus for stabilizing a large boring head when drilling a bore hole in the earth.

2. Description of the Prior Art

Large boring heads employed for drilling bore holes in the earth have employed roller stabilizers mounted on the head for engaging the earth for stabilizing the head as it is rotated for drilling purposes. In some cases, the roller stabilizers employed on the large heads do not provide the stabilization needed. Moreover, the prior art heads and their roller stabilizers do not have the capability of increasing the stabilizing points around the axis of the head without increasing the mounting points angularly around the head axis. This is difficult due to space limitation.

SUMMARY OF THE INVENTION

It is an object of the invention to provide a reversible roller stabilizer extension bracket for stabilizing a large boring head or the like while drilling a bore hole in the earth. The bracket may be attached to a given plate or surface of a hub in a first position or turned 180° and attached thereto in a second position to locate its roller means in either of two angular positions relative to the axis of the hub.

The number of extension brackets mounted to the hub may be equal to the number of mounting plates on the hub to provide the same number of stabilizing points or the number of extension brackets mounted to the hub may be equal to twice the number of mounting plates on the hub to provide twice the number of stabilizing points. In order to mount twice the number of extension brackets to the hub as there are mounting plates, half of the extension brackets will be reversed in their mounting positions and mounted to the mounting plates in a plane different from that of the other half.

The extension bracket comprises a bracket mounting plate and a roller mounting plate coupled together at spaced apart positions by support structure. A roller means is attached to said roller mounting plate for engaging the earth for use for stabilizing the boring head. The axis of the roller means defines a scalene triangle with two side edges of its bracket mounting plate such that the axis of said roller means is located on one side of a plane perpendicular to and bisecting said bracket mounting plate between its two side edges. The bracket mounting plate of the extension bracket is adapted to be attached to a mounting plate or surface of the hub in a first position or turned 180° and attached thereto in a second position such that the axis of its roller means is parallel to the axis of the hub and is located either on one side or the other of a plane extending from the length of the axis of the hug outward and bisecting the bracket mounting plate between its two side edges when the bracket mounting plate is attached to the mounting plate or surface of the hub in said first or second position.

Figure 5:
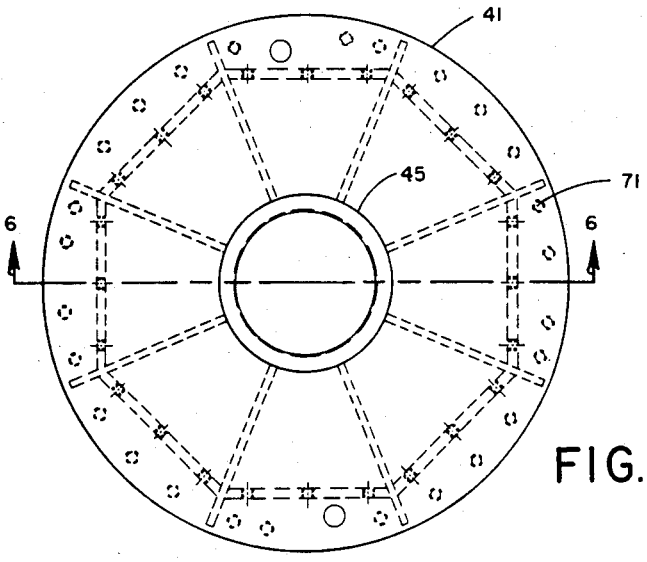
FIG. 5 is a top plan view of the hub of the stabilizing apparatus of FIGS. 1 and 2.
Figure 6:
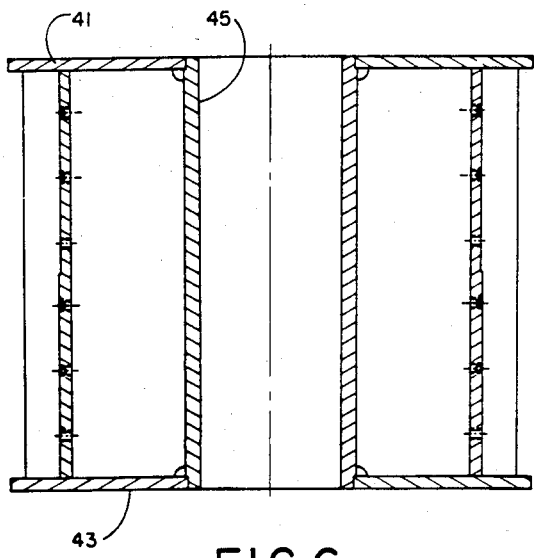
FIG. 6 is a cross-sectional view of FIG. 5, taken through the lines 6—6 thereof.
Figure 7:
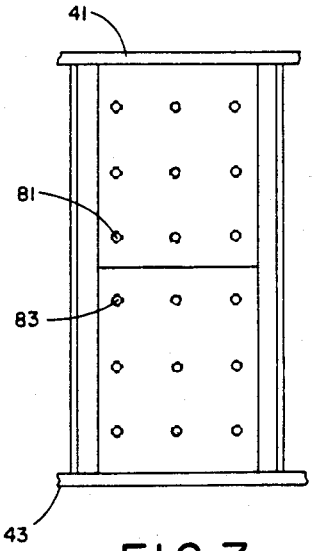
FIG. 7 is a side view of one of the mounting plates of the hub of FIG. 5.

The relative scales of FIGS. 5–7 are the same and of FIGS. 8–11 are the same. Other than these Figures, the drawings have different scales relative to each other.

DESCRIPTION OF THE PREFERRED EMBODIMENTS

Figure 1:
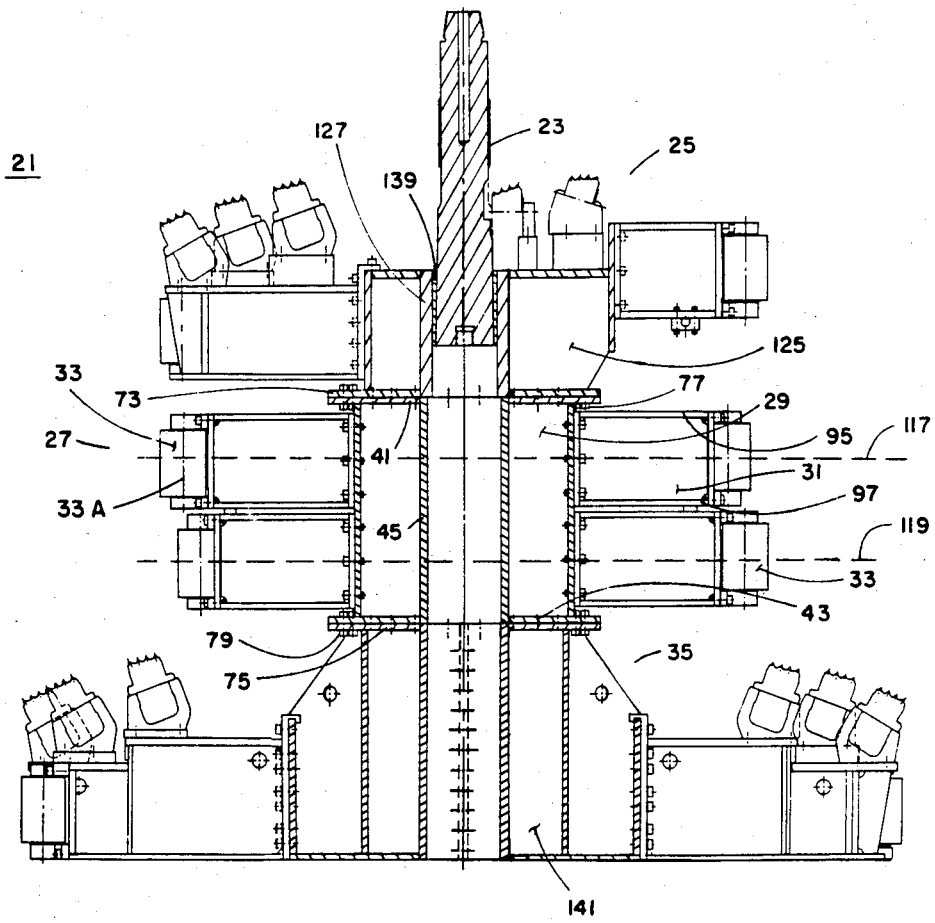
FIG. 1 is a cross-sectional side view of the stabilizing apparatus of the invention attached to a boring head assembly.
Figure 12:
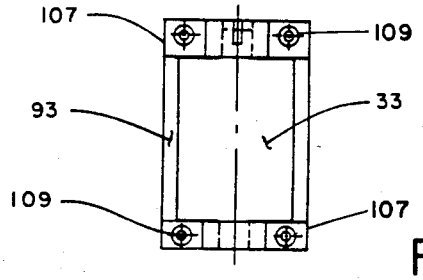
FIG. 12 is a plan view of one of the rollers adapted to be attached to the roller mounting plate of FIG. 10.

Referring to FIG. 1, there is illustrated a bore hole drilling assembly 21, comprising a drill stem 23 attached to an upper raise boring head 25. The lower end of the head 25 is attached to the upper end of a stabilizing apparatus 27 comprising a hub 29 which supports the reversible roller stabilizing extension brackets or wings 31 of the invention. Rollers 33 are mounted to the outer ends of the brackets 31. The outside diameter of the stabilizing apparatus 27 is the same as that of the raise boring head 25. The lower end of the hub 29 is attached to the upper end of a lower raise boring head 35, the diameter of which is greater than that of the raise boring head 25. The upper end of the stem 23 is attached to an upper drill pipe assembly, not shown, which is rotated by a power mechanism and moved upward for drilling purposes.

The assembly 21 of FIG. 1 is employed in mining operations to drill a hole in the earth having a diameter the same as that of the raise boring head 35. The bore hole may be drilled in two passes or in one pass. If two passes are employed, in the first pass, the stabilizing apparatus 27 and the lower raise boring head 35 will not be employed in the assembly and only the upper raise boring head 25 will be used initially to drill a bore hole having a diameter equal to that of the raise boring head 25. The stem 23 will be lowered through a pre-drilled small diameter hole. In the first pass, the head 25 is connected to the stem 23 and the stem 23 rotated and raised upward to rotate the head 25 against the earth to drill a bore hole in the earth as the head 25 is moved upward. The stem 23 and the head 25 then may be lowered through the bore hole and the stabilizing apparatus 27 and the raise boring head 35 attached as shown in FIG. 1 and the stem 23 rotated and moved upward to cause the raise boring head 35 to drill a bore hole in the earth having a diameter equal to that of the head 35. The rollers 33 of the brackets 31 bear and roll against the wall of the bore hole generated or drilled by the upper head 25 for stabilizing the larger diameter head 35. On the second pass, the cutters may be detached from the head 25.

In the embodiment wherein the desired hole diameter is drilled in a single pass, the stem is lowered through the pre-drilled small diameter hole; the head 25 is connected to the stem 23; the stabilizing apparatus 27 is connected to the head 25; the head 35 is connected to the stabilizing apparatus 27 as shown in FIG. 1; and the complete assembly is rotated and raised by the stem 23 with the head 25 forming its hole and the lower raise boring head 35 forming the desired larger diameter hole in a single pass. The rollers 33 of the brackets 31 will bear and roll against the wall of the hole drilled by the upper head 25 to stabilize the lower head 35.

Referring to the stabilizing apparatus 27, the hub 29 comprises two circular mounting plates 41 and 43 connected together by a tubular member 45, eight flat hub mounting plates 51–58, and eight radially extending support plates 61–68. Each of the plates 61–68 also is connected to the tubular member 45 and between two of the flat mounting plates 51–58. The plate 43 is the same as plate 41 and both of the plates 41 and 43 have outer holes 71 formed therethrough which match corresponding holes formed through circular lower and upper plates 73 and 75 of heads 25 and 35 for allowing plates 41 and 73 to be connected together by bolts 77 and plates 43 and 75 to be connected together by bolts 79. Each of the flat mounting plates 51–58 of the hub 29 has an upper set of nine apertures 81 and a lower set of nine apertures 83 formed therethrough for allowing attachment thereto of an extension brackets 31 in an upper position or in a lower position or for allowing attachment thereto of two extension brackets in upper and lower positions.

Figure 11:
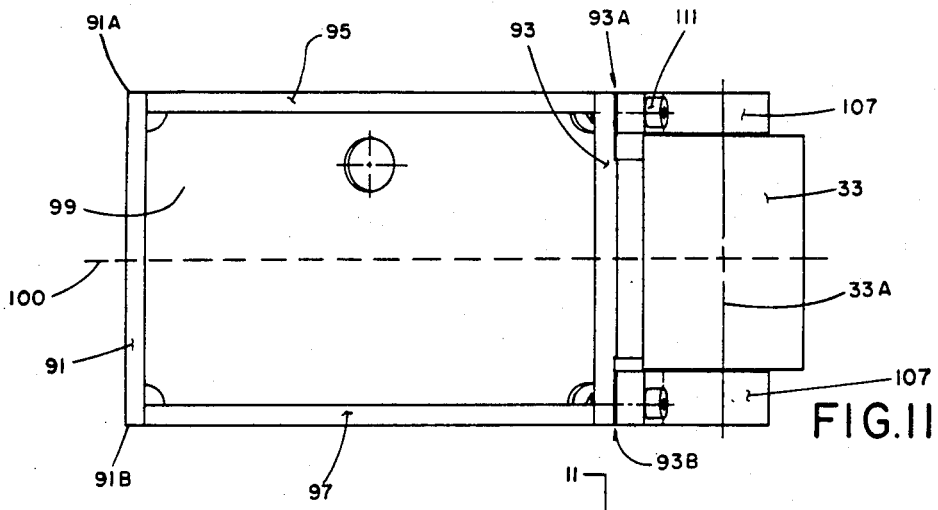
FIG. 11 is a view of FIG. 8 as seen from lines 11—11 thereof with the roller brackets and rollers attached.
Figure 8:
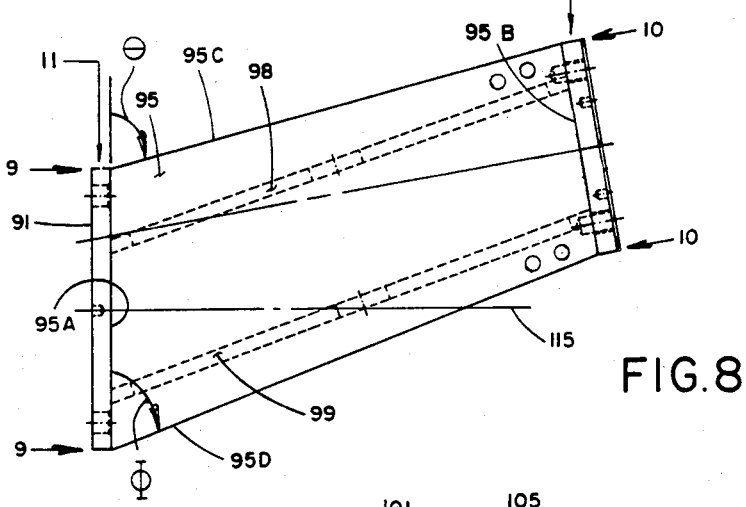
FIG. 8 is a plan view of one of the roller extension brackets of the invention.
Figure 9:
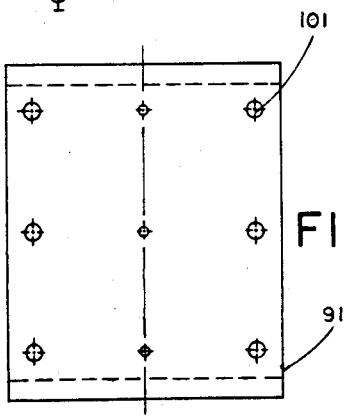
FIG. 9 is a plan view of the bracket mounting plate of the extension bracket of FIG. 8 as seen from lines 9—9 thereof.
Figure 10:
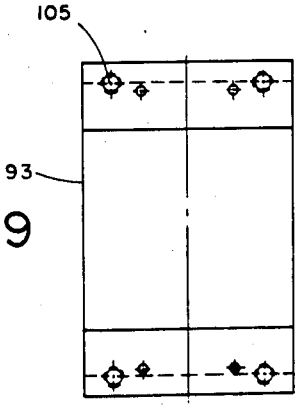
FIG. 10 is a plan view of the roller mounting plate of the extension bracket of FIG. 8 as seen from lines 10—10 thereof.

Each of the extension bracket 31 is formed by an inner bracket mounting plate 91 and an outer roller mounting plate 93 attached together by two extension plates 95 and 97 and two side plates 98 and 99. Plates 98 and 99 also are attached to plates 95 and 97. Plates 95 and 97 have the same shape. Referring to plate 95 in FIG. 8, its inner and outer edges 95A and 95B form an angle of 10° relative to each other. The angle r between side edge 95C and the plane of edge 95A is equal to about 75° and the angle d between side edge 95D and the plane of edge 95A is equal to about 85°. As seen in FIG. 11, plates 95 and 97 of a bracket 31 are parallel to each other and to a plane 100 bisecting the plates 91 and 93 between their edges 91A, 91B, and 93A, 93B. Plates 91 and 93 are perpendicular to plane 100 and in the plane 100, the plates 91 and 93 are non-parallel with each other.

Bracket mounting plate 91 has a set of nine apertures 101 formed therethrough which match each of the sets of apertures 81 and 83 of each of the hub mounting plates 51–58 for allowing the plate 91 to be attached with bolts 103 to any of the hub mounting plates 51–58 by way of apertures 81 or 83 in either one position or in a reversed position. The roller mounting plate 93 has a set of four apertures 105 formed therethrough. Each of the rollers 33 is supported for rotation by two roller brackets 107 each of which has a set of two apertures 109 formed therethrough which match the apertures 105 of the plate 93 for allowing the roller brackets 107 to be attached to the plate 93 by way of bolts 111. When the brackets 107 are attached to the plate 93, the axis 33A of the roller 33 is perpendicular to the plane 100.

Figure 2:
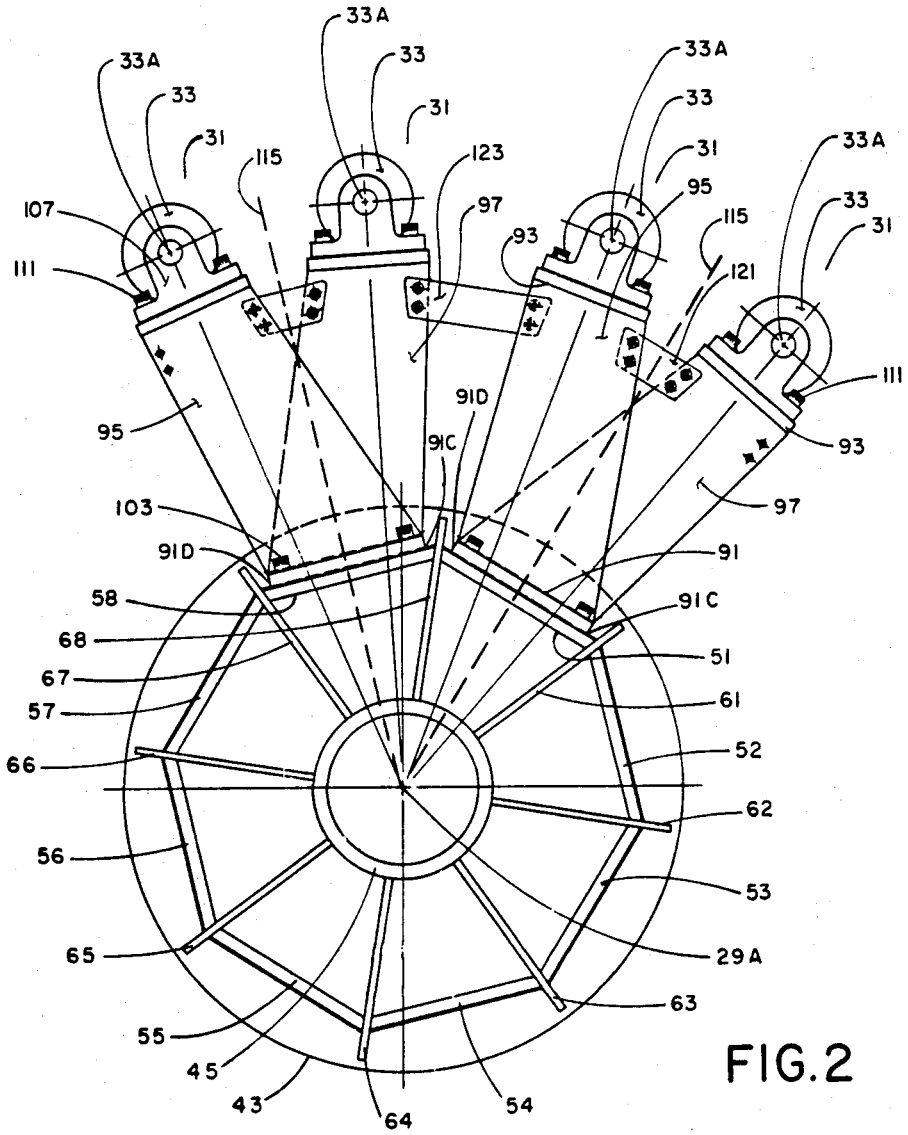
FIG. 2 is a plan view of the stabilizing apparatus with its upper circular mounting plate removed illustrating two of its mounting plates each having two roller extension brackets of the invention attached thereto in reversed positions.
Figure 3:
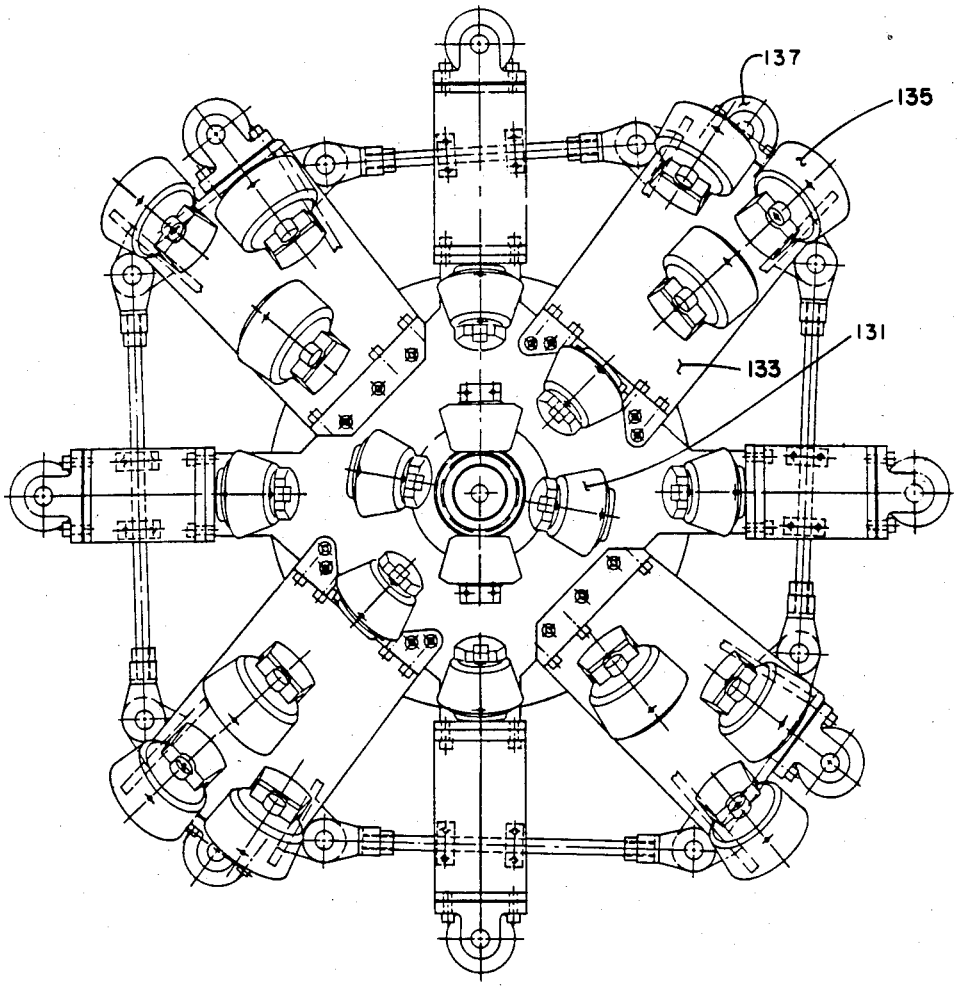
FIG. 3 is a plan view of the upper raise boring head of FIG. 1.

As seen in FIG. 2, the axis 33A of the roller 33 when mounted to the plate 93 of the bracket 31 forms a scalene triangle with the side edges 91C and 91D of the plate 91. A scalene triangle is defined as a triangle having three sides of unequal length. The axis 33A of the roller 33 is located on one side of a plane 115 perpendicular to the plate 91 and bisecting the plate 91 between its side edges 91C and 91D. The plate 91 of the bracket 31 can be attached to either of the hub plates 51–58 by way of its upper set of holes 81 such that its plates 95 and 97 are in upper and lower positions respectively or reversed 180° and attached thereto such that its plates 95 and 97 are in lower and upper positions respectively. Similarly, the plate 91 of the bracket 31 can be attached to either of the hub plates 51–58 by way of its lower set of holes 83 such that its plates 95 and 97 are in upper and lower positions respectively or reversed 180° and attached thereto such that its plates 95 and 97 are in lower and upper positions respectively. When attached to a given plate 51–58 in either position using either holes 81 or 83, the axis 33A of the roller 33 will be parallel to the axis 29A of the hub 29 and located on either side of the plane 115 extending from the length of the axis 29A of the hub 29 and outward bisecting the hub plate (and the bracket mounting plate 91) between its side edges to which the mounting plate 91 is attached. Thus, if eight angular stabilizing positions are desired, eight of the brackets 31 will be mounted to the plates 51–58, using either the upper set of holes 81 or the lower set of holes 83, in the same relative positions such that the rollers of each of the eight brackets will be located on the left or the right side of the corresponding plane 115 extending from the axis 29A and bisecting the hub plate to which the bracket 31 is mounted as seen in FIG. 2. For example, in FIG. 2, the rollers of the upper brackets 31 mounted to hub plates 51 and 58 are located to the left of their associated planes 115. If sixteen angular stabilizing positions are desired, then two of the brackets 31 will be attached to each of the mounting plates 51–58 using both sets of holes 81 and 83 and positioned such that the two brackets attached to a given hub mounting plate will be located on opposite side of its plane 115. This is shown in FIG. 2 wherein an upper bracket 31 and a lower bracket 31 are attached to each of plates 51 and 58. As shown in FIG. 1, the brackets 31 attached to the hub mounting plates using holes 81 are located in one plane 117 transverse to the hub axis 29A and the brackets 31 attached to the hub mounting plates using holes 83 are located in a second plane 119 transverse to the hub axis 29A and which is spaced from and parallel to the plane 117. Connecting tabs 121 and 123 are employed to connect adjacent brackets 31 at the two different levels for support purposes.

Thus, the apparatus of the invention provides the capability of doubling the angular stabilizing positions, if needed, without doubling the hub mounting plates. The apparatus can be used with large heads with stabilizing rollers, if their stabilizing rollers do not provide the stabilization needed, or it can be used with heads without stabilizing rollers.

Figure 4:
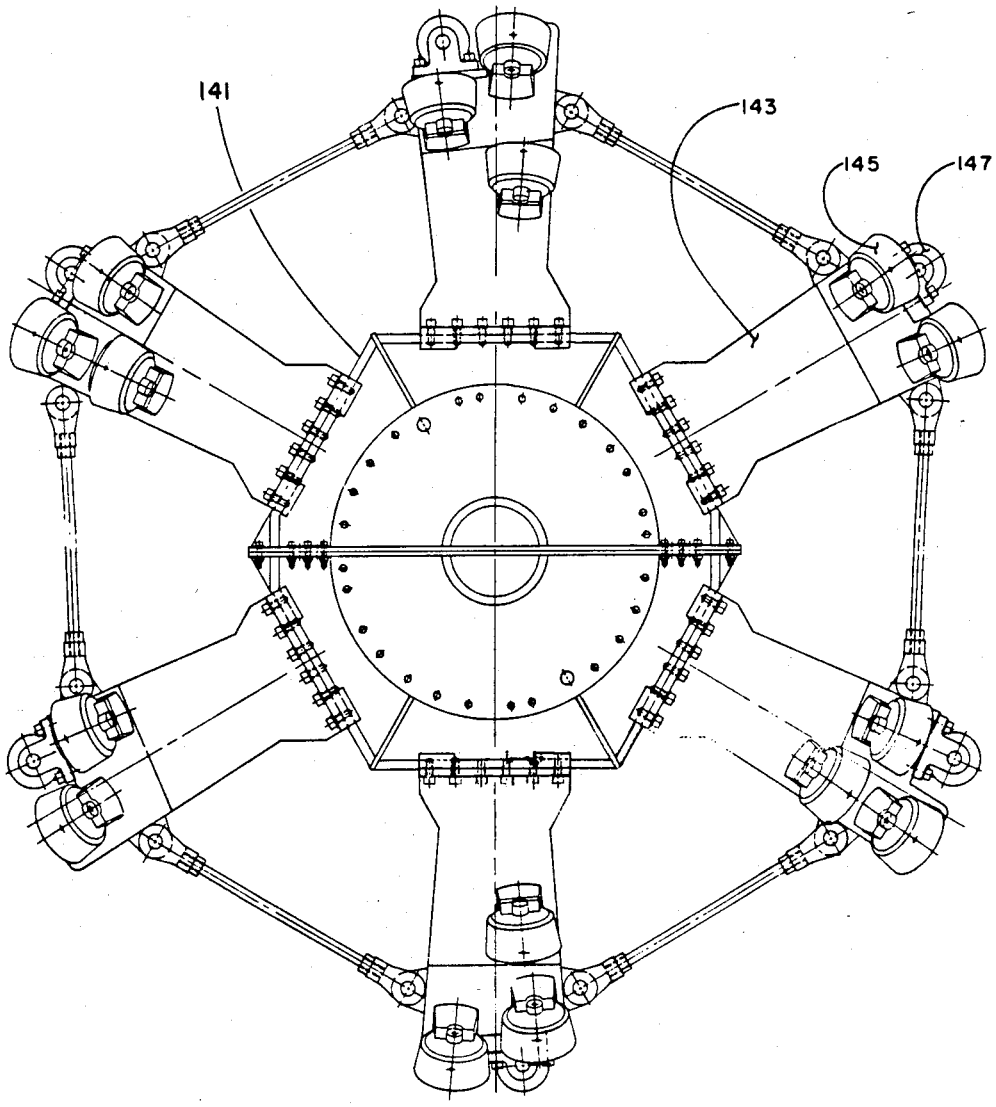
FIG. 4 is a plan view of the lower raise boring head of FIG. 1.

Referring to FIGS. 1 and 2, the raise boring head 25 is of conventional design and comprises central hub structure 125 connected to a central tubular member 127. The hub structure 125 directly supports inner cutters 131 and wing plates 133 attached to the hub structure 125, support outer cutters 135. Some of the wind plates 133 also support rollers illustrated at 137 to aid in stabilizing the head 25. The stem 23 is hydraulically inserted within the tubular member 127 and is secured thereto with a taper lock system comprising a tapered tubular member 139. The circular mounting plate 73 is attached to the tubular member 127 and to the hub structure 125. The raise boring head 35 also is of conventional design, and as also seen in FIG. 4, comprises a central hub member 141 having wings 143 for supporting cutters 145 and stabilizing rollers 147. The circular mounting plate 75 is attached to the hub structure 141.

In one embodiment, the head 25 has a maximum diameter of 14 feet and the head 35 has a maximum diameter of 20 feet.

Although the stabilizing apparatus including hub 29 and the extension brackets 31, as described above, is separate from the boring heads, it is to be understood that the hub 29 can be an integral part of a boring head. In addition, the hub of the boring head itself may have mounting plates each of which is adpated to receive two of the extension brackets in the manner as shown in FIG. 2.

Although the invention was described in conjunction with a raise boring head, it is to be understood that it could be used in conjunction with other types of heads such as a shaft head.

I claim:

1. A stabilizer apparatus for stabilizing a head having cutters mounted thereon for drilling a hole in the earth upon rotation of the head by way of a stem, comprising:

a hub adapted to be coupled to the stem for rotation therewith, said hub having a plurality of mounting surfaces located angularly around its axis and radially outward therefrom, a plurality of extension brackets, each extension bracket having a bracket mounting plate means at one end and a roller mounting plate means at the other end, a roller means attached to each of said roller mounting plate means for engaging the earth for stabilizing the head, the axis of each of said roller means defining a scalene triangle with two side edges of the bracket mounting plate means of its extension bracket, the bracket mounting plate means of each of said extension brackets being adapted to be attached to any of said mounting surfaces in a first position or turned 180° and attached thereto in a second position such that the axis of its roller means is parallel to the axis of said hub and is located either on one side or the other of a plane extending from the length of the axis of said hub outward and bisecting said bracket mounting plate means between its two side edges when said bracket mounting plate means is attached to any of said mounting surfaces in said first or second positions, each of said hub mounting surfaces having one of said extension brackets attached thereto in one of said positions by way of its bracket mounting plate means in at least one plane transverse to said axis of said hub whereby said extension brackets will rotate with said hub when said hub is rotated by the stem.

2. The stabilizer apparatus of claim 1, wherein:

each of said bracket mounting plate means attached to said hub mounting surfaces in said one plane is attached therto in said first position.

3. The apparatus of claim 2, wherein:

the radial distance between each of said roller means and the axis of said hub is the same.

4. The stabilizer apparatus of claim 1, wherein:

each of said hub mounting surfaces has an axial dimension sufficient to accept two of said bracket mounting plate means, each of said hub mounting surfaces having one of said extension brackets attached thereto in one of said positions by way of its bracket mounting plate means in a second plane spaced from and parallel to said one plane such that each of said hub mounting surface has two axially spaced apart extension brackets attached thereto.

5. The stabilizer apparatus of claim 2, wherein:

each of said hub mounting surfaces has an axial dimension sufficient to accept two of said bracket mounting plate means, each of said hub mounting surfaces having one of said extension brackets attached thereto by way of its bracket mounting plate means in a second plane spaced from and parallel to said one plane such that each of said hub mounting surfaces has two axially spaced apart extension brackets attached thereto, each of said bracket mounting plate means attached to said hub mounting surfaces in said second plane is attached thereto in said second position.

6. The apparatus of claim 5, wherein:

said one plane is defined as a first transverse plane said second plane is defined as a second transverse plane, the radial distance between each of said roller means and the axis of said hub is the same, the distance between adjacent roller means in each of said transverse planes is the same.

7. The stabilizer apparatus of claim 1, wherein:

each of said hub mounting surfaces is perpendicular to a plane extending from the length of the axis of said hub outward and bisecting said mounting surface between its side edges, said bracket mounting plate means and said roller mounting plate means of each of said extension brackets is perpendicular to a plane extending through each of said plate means and non-parallel with each other in said plane extending through each of said plate means.

8. The stabilizer apparatus of claim 1, comprising the combination therewith of a head having cutters mounted thereon:

said hub being separate from said head and being adapted to be attached to said head at a location next to said head such that the axis of said hub is aligned with the axis of said head.

9. The combination of claim 8, wherein:

the maximum diameter of said stabilizer apparatus is less than the maximum diameter of said head and its cutters, said stabilizer apparatus being adapted to be located in a hole having generally the same diameter as that of said stabilizer apparatus, with said stabilizer apparatus being located ahead of the direction of axial movement of said head such that said head when rotated will increase the diameter of the hole, with said stabilizer apparatus acting to stabilize said head as said stabilizer apparatus is moved along the hole ahead of said head.

10. A stabilizer apparatus for stabilizing a head having cutters mounted thereon for drilling a hole in the earth upon rotation of the head by way of a stem, comprising:

a hub adapted to be coupled to the stem for rotation therewith, said hub having a plurality of hub plate means located angularly around its axis and radially outward therefrom, a plurality of extension brackets, each extension bracket having a bracket mounting plate means at one end and a roller mounting plate means at the other end, a roller means attached to each of said roller mounting plate means for engaging the earth for stabilizing the head, the axis of each of said roller means defining a scalene triangle with two side edges of the bracket mounting plate means of its extension bracket, the bracket mounting plate means of each of said extension brackets being adapted to be attached to any of said hub plate means in a first position or turned 180° and attached thereto in a second position such that its roller means is located either on one side or the other of a plane extending from the length of the axis of said hub outward and bisecting said bracket mounting plate means between its two side edges when said bracket mounting plate means is attached to any of said hub plate means in said first or second positions, each of said hub plate means having one of said extension brackets attached thereto in one of said positions by way of its bracket mounting plate means in at least one plane transverse to said axis of said hub whereby said extension brackets will rotate with said hub when said hub is rotated by the stem.

11. A stabilizer apparatus for stabilizing a head having cutters mounted thereon for drilling a hole in the earth upon rotation of the head by way of a stem, comprising:

a hub adapted to be coupled to the stem for rotation therewith, said hub having a plurality of mounting means located angularly around its axis and radially outward therefrom, a plurality of extension brackets, each extension bracket having a bracket mounting plate means at one end and a roller mounting plate means at the other end, a roller means attached to each of said roller mounting plate means for engaging the earth for stabilizing the head, the axis of each of said roller means being located on one side of a plane perpendicular to and bisecting its associated bracket mounting plate means, the bracket mounting plate means of each of said extension brackets being adapted to be attached to any of said mounting means of said hub in a first position or turned 180° and attached thereto in a second position such that the axis of its roller means is located either on one side or the other of a plane extending from the length of the axis of said hub outward and bisecting said bracket mounting plate means between its side edges when said bracket mounting plate means is attached to any of said mounting means of said hub in said first or second positions, each of said hub mounting means having one of said extension brackets attached thereto in one of said positions by way of its bracket mounting plate means in at least one plane transverse to said axis of said hub whereby said extension brackets will rotate with said hub when said hub is rotated by the stem.

12. The stabilizer apparatus of claim 11, wherein:

each of said bracket mounting plate means attached to said hub mounting means in said one plane is attached thereto in said first position.

13. The stabilizer apparatus of claim 12, wherein:

each of said hub mounting means has an axial dimension sufficient to accept two of said bracket mounting plate means, each of said hub mounting means having one of said extension brackets attached thereto by way of its bracket mounting plate means in a second plane spaced from and parallel to said one plane, each of said bracket mounting plate means attached to said hub mounting means in said second plane is attached thereto in said second position.

14. A stabilizer extension bracket for attachment to a mounting surface of a hub of a head apparatus having cutters, for stabilizing the head as it is rotated for drilling a hole in the earth, comprising:

a bracket mounting plate and a roller mounting plate coupled together at spaced apart positions by support structure, a roller means attached to said roller mounting plate for engaging the earth for use for stabilizing the head, the axis of said roller means defining a scalene triangle with two side edges of said bracket mounting plate such that the axis of said roller means is located on one side of a plane perpendicular to and bisecting said bracket mounting plate between its two side edges, said bracket mounting plate and said roller mounting plate being perpendicular to a plane extending through each of said plates and non-parallel with each other in said plane extending through each of said plates, the axis of said roller means being perpendicular to said plane extending through each of said plates, said bracket mounting plate of said extension bracket being adapted to be attached to a mounting surface of the hub in a first position or turned 180° and attached thereto in a second position such that the axis of its roller means is parallel to the axis of the hub and is located either on one side or the other of a plane extending from the length of the axis of the hub outward and bisecting said bracket mounting plate between its two side edges when said bracket mounting plate is attached to the mounting surface of the hub in said first or second positions.

15. A stabilizer apparatus for stabilizing a head having cutters mounted thereon for drilling a hole in the earth upon rotation of the head by way of a stem, comprising:

a hub adapted to be coupled to the stem for rotation therewith, said hub having at least one mounting means located radially outward from its axis, an extension bracket, said bracket having a bracket mounting plate means at one end and a roller mounting plate means at the other end, a roller means attached to said roller mounting plate means for engaging the earth for stabilizing the head, the axis of said roller means being located on one side of a plane perpendicular to and bisecting said bracket mounting plate means, the bracket mounting plate means of said extension bracket being adapted to be attached to said mounting means of said hub in a first position or turned 180° and attached thereto in a second position such that the axis of its roller means is located either on one side or the other of a plane extending from the length of the axis of said hub outward and bisecting said bracket mounting plate means between its side edges when said bracket mounting plate means is attached to said mounting means of said hub in said first or second positions, said hub mounting means having said extension bracket attached thereto in said first position by way of its bracket mounting plate means in one plane transverse to said axis of said hub whereby said extension bracket will rotate with said hub when said hub is rotated by the stem.

16. The stabilizer apparatus of claim 15, wherein:

said hub mounting means has an axial dimension sufficient to accept two of said bracket mounting plate means, said hub mounting means having one of said extension brackets attached thereto by way of its bracket mounting plate means in a second plane spaced from and parallel to said one plane such that said hub mounting means has two axially spaced apart extension brackets attached thereto, said bracket mounting plate means attached to said hub mounting means in said second plane is attached thereto in said second position.

* * * * *